US006102483A

United States Patent [19]

Cacique

[11] Patent Number: 6,102,483

[45] Date of Patent: Aug. 15, 2000

[54] PROCESS FOR PREPARING THE EXPOSED SURFACE OF A ROCK FORMATION TO PERMIT THE EXTRACTION OF PARALLELEPIPED SHAPED BLOCKS OF ROCK READY FOR FINAL PROCESSING, AND PROCESS AND EXTRACTOR FOR EXTRACTING SUCH BLOCKS

[76] Inventor: Geraldo Antunes Cacique, BR 116, KM. 89-Fazenda Ouro Verde 39620, Medina, Minas Gerais, Brazil

[21] Appl. No.: 08/182,125

[22] PCT Filed: Jul. 16, 1992

[86] PCT No.: PCT/BR92/00011

§ 371 Date: Jan. 13, 1994

§ 102(e) Date: Jan. 13, 1994

[87] PCT Pub. No.: WO93/02274

PCT Pub. Date: Feb. 4, 1993

[30] Foreign Application Priority Data

Jul. 16, 1991 [BR] Brazil ..... PI 9103071
Jul. 16, 1992 [WO] WIPO ..... PCT/BR92/00011

[51] Int. Cl.[7] ..... E21C 41/26; E21C 47/10

[52] U.S. Cl. ..... 299/15; 125/23.01

[58] Field of Search ..... 299/15, 41; 125/23.01

[56] References Cited

FOREIGN PATENT DOCUMENTS

| | | | |
|---|---|---|---|
| 541467 | 10/1955 | Belgium | 299/15 |
| 1375448 | 11/1963 | France . | |
| 2557199 | 6/1985 | France . | |
| 2600375 | 12/1987 | France . | |
| 477243 | 11/1975 | U.S.S.R. | 299/15 |
| 9206276 | 4/1992 | WIPO . | |

*Primary Examiner*—David J. Bagnell

[57] ABSTRACT

The present invention refers to the extraction from rock formations of blocks of rock that are already of a paralellepiped shape and thus do not require final time consuming finishing operations. The process of the invention involves cutting a long slot in the formation beneath a slice of rock to be removed and then drilling various orthogonal series of parallel aligned perforations to define cutting surfaces that are separated using metal plugs applied to the perforations. In this manner parallelepiped shaped small blocks are obtained directly and can be removed from the formation in a stage virtually ready for commercialization. Equipment in the form of an extractor is also described which permits the simultaneous formation of the slot and the perforations.

13 Claims, 15 Drawing Sheets

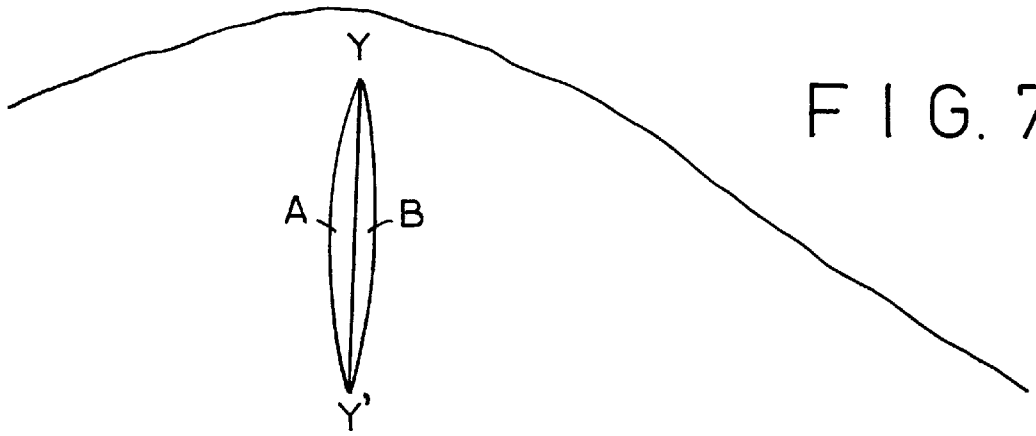
FIG. 7
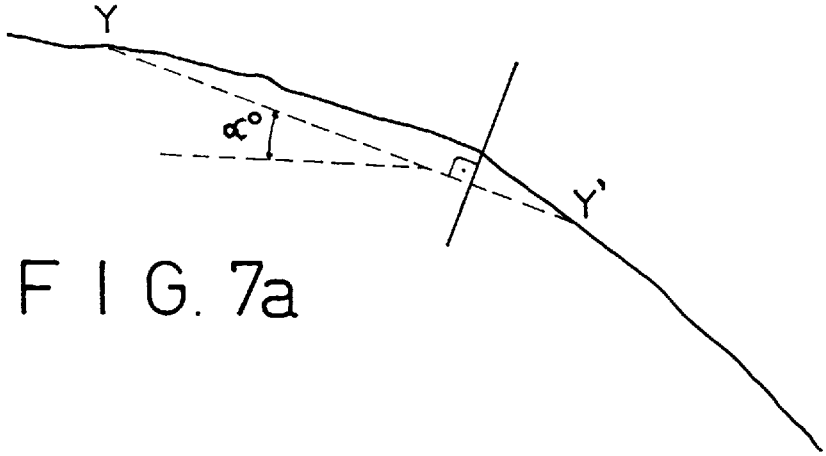
FIG. 7a
FIG. 8
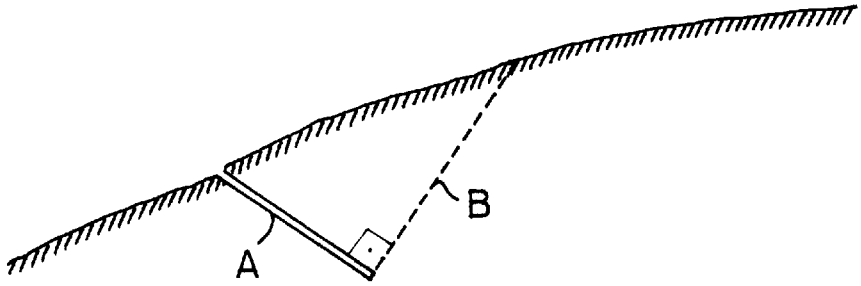

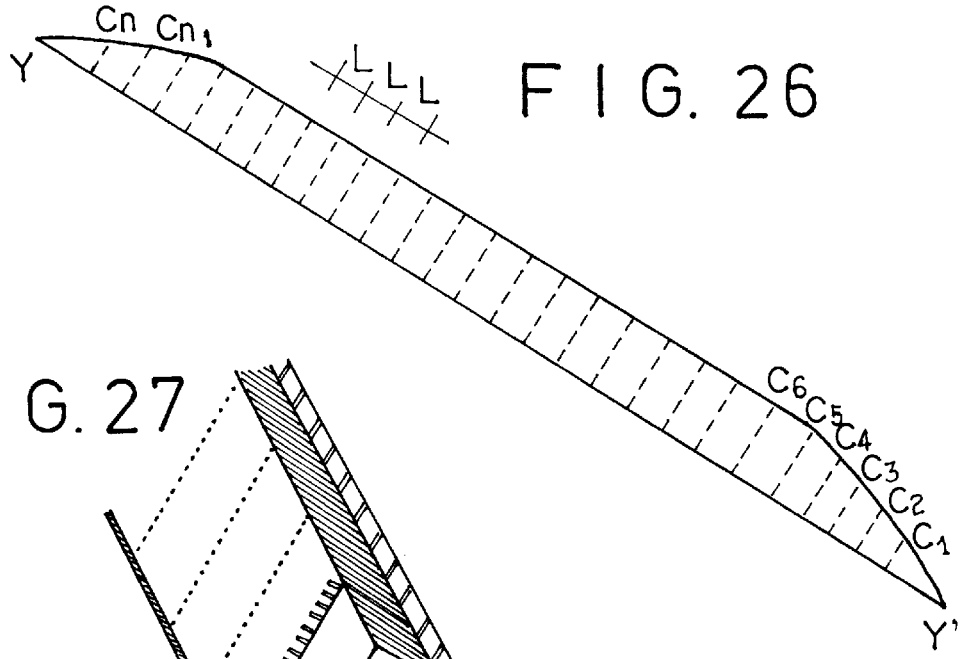
FIG. 26
FIG. 27
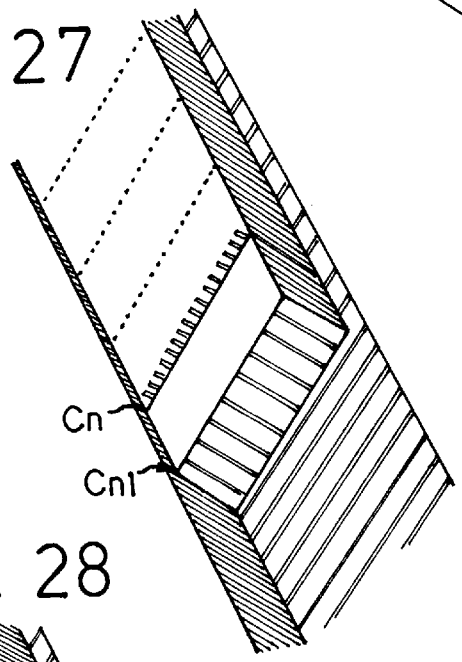
FIG. 28
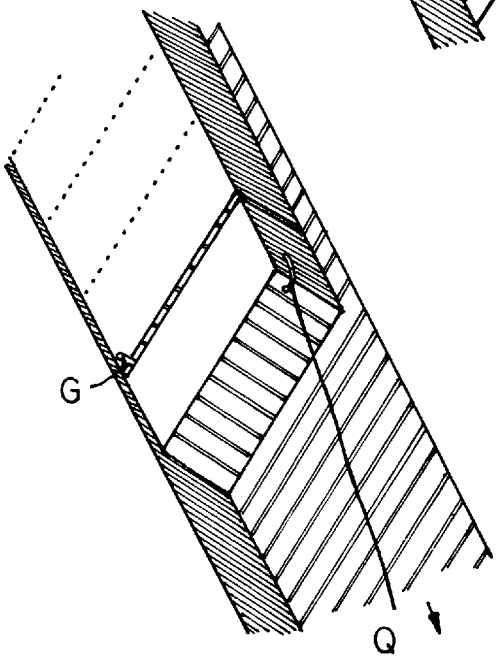
FIG. 29
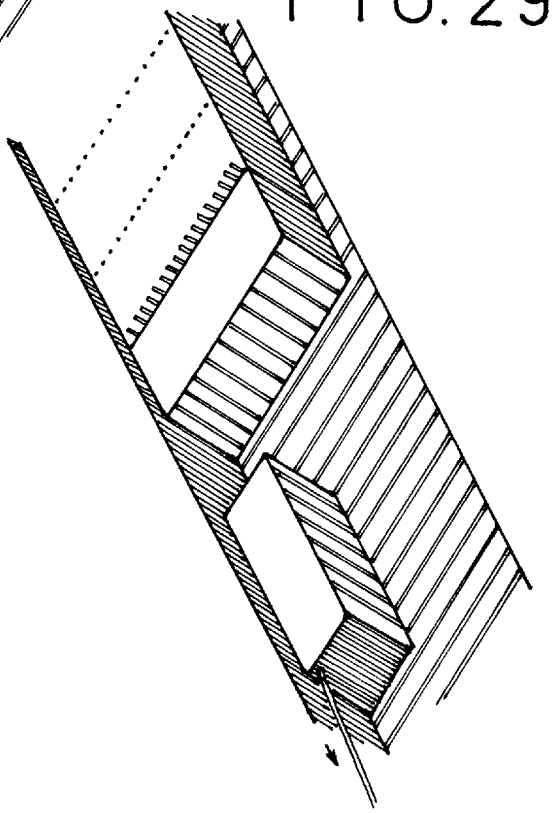

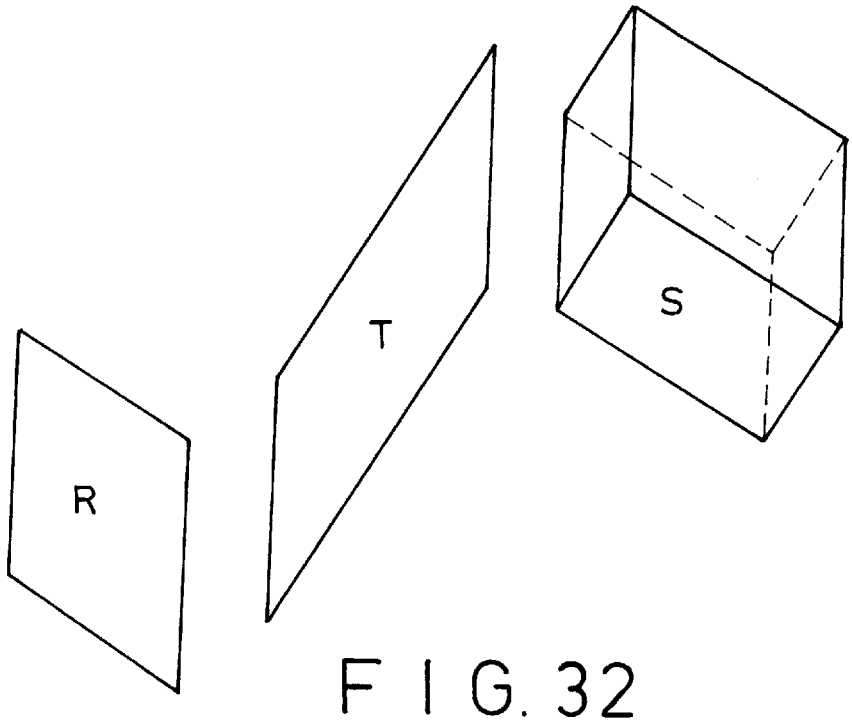
FIG. 32
FIG. 33
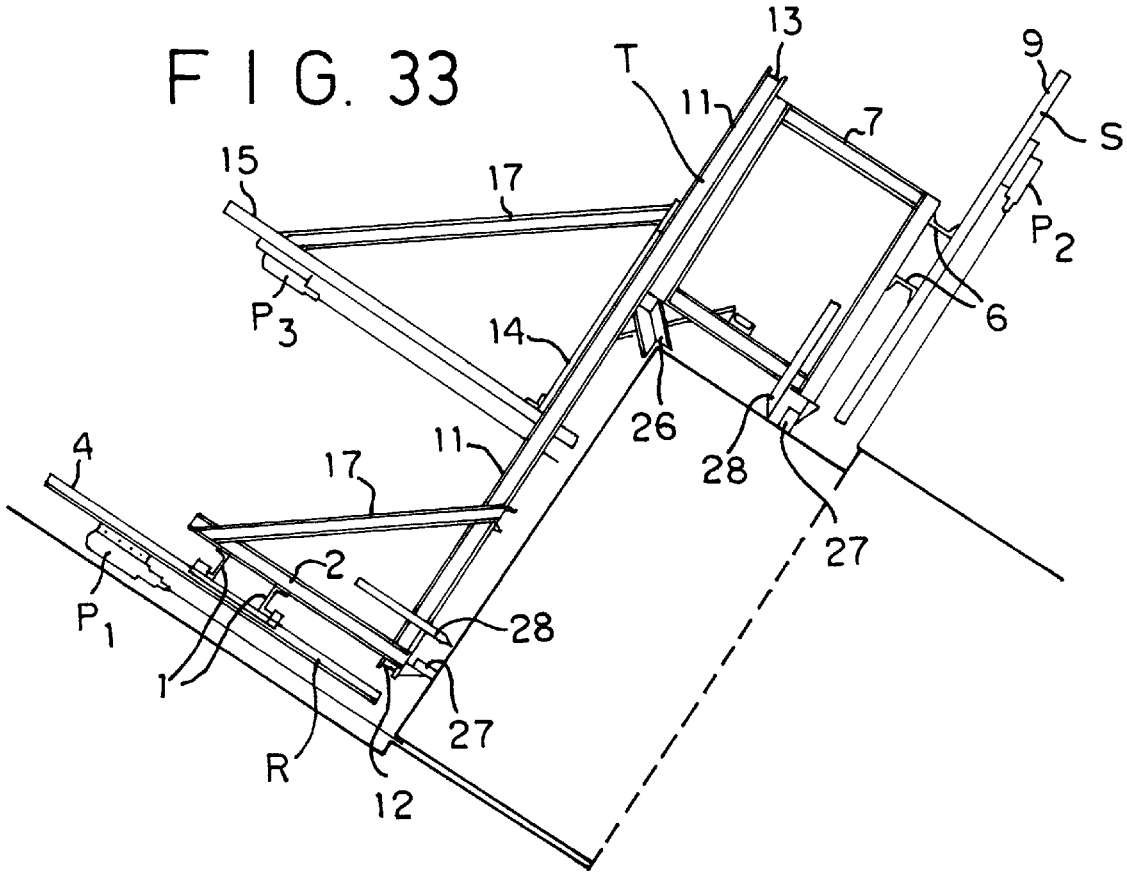

FIG. 36
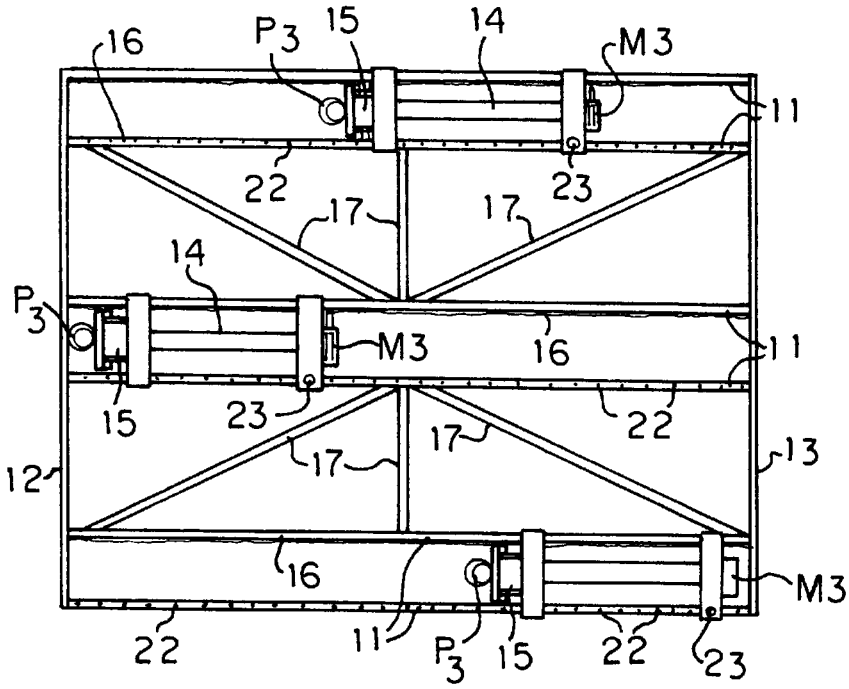
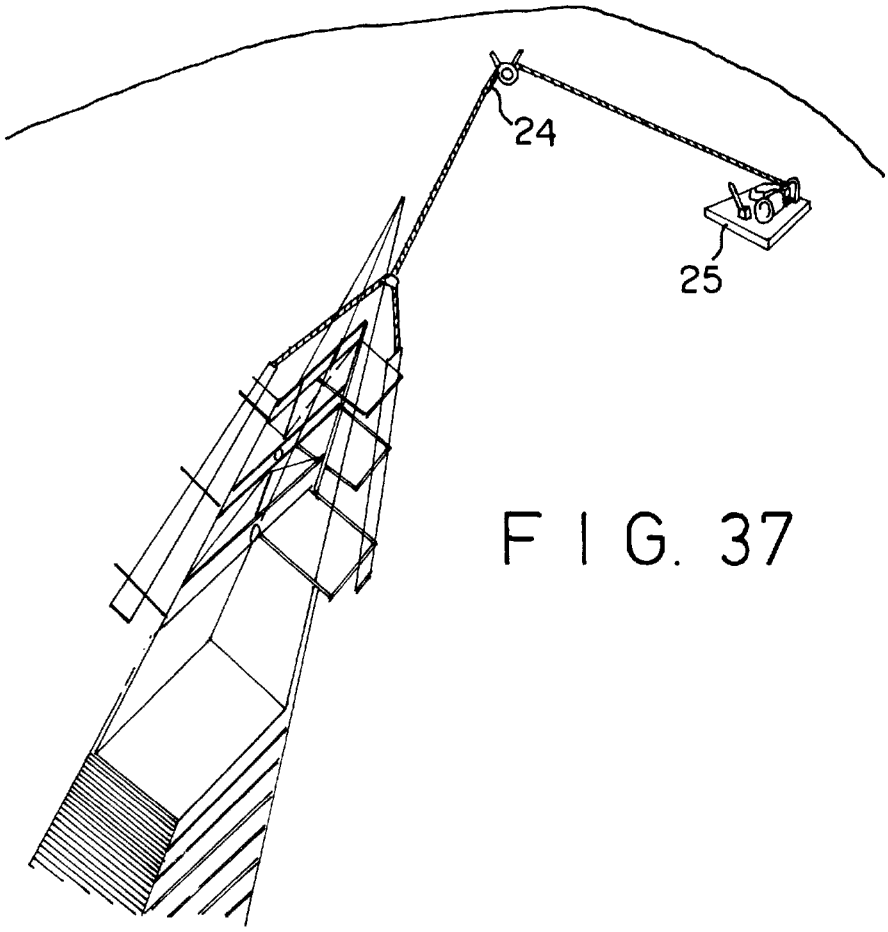
FIG. 37

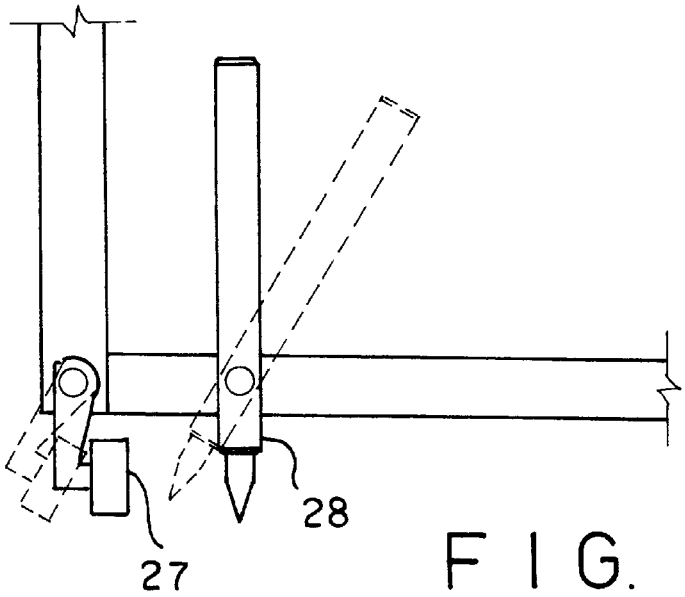
FIG. 38
FIG. 39
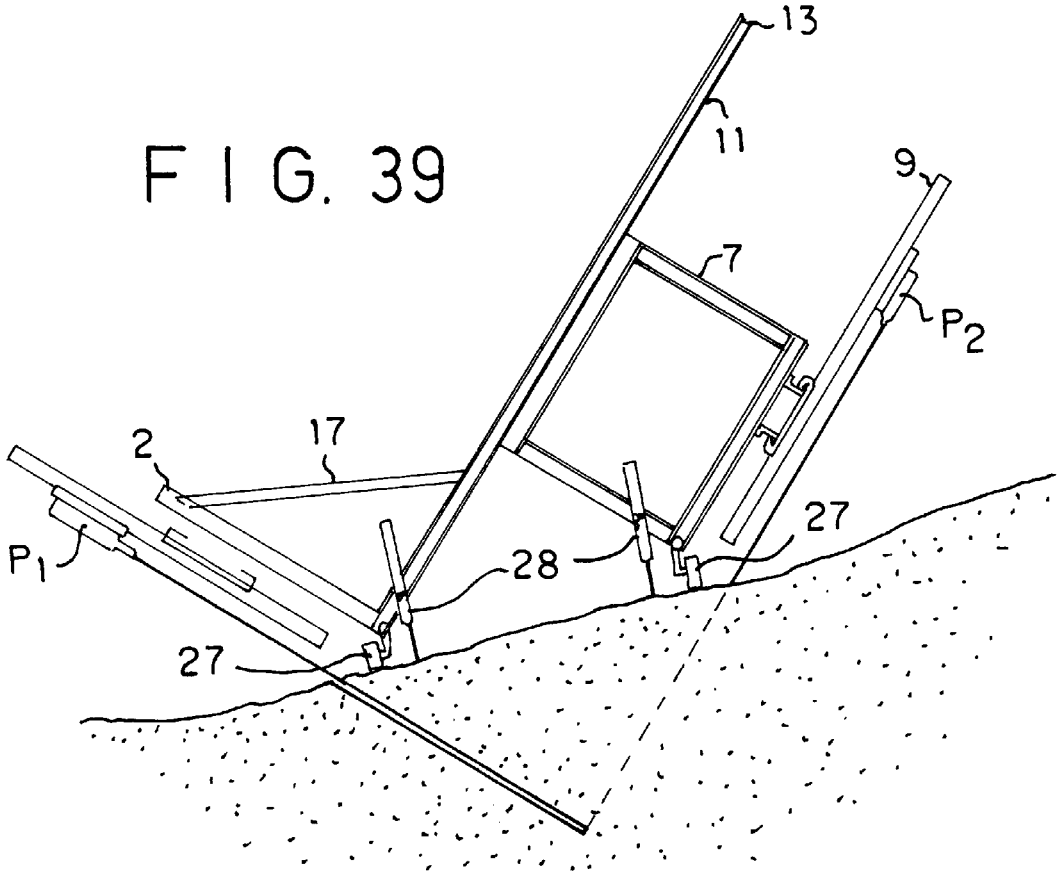

PROCESS FOR PREPARING THE EXPOSED SURFACE OF A ROCK FORMATION TO PERMIT THE EXTRACTION OF PARALLELEPIPED SHAPED BLOCKS OF ROCK READY FOR FINAL PROCESSING, AND PROCESS AND EXTRACTOR FOR EXTRACTING SUCH BLOCKS

BACKGROUND OF THE INVENTION

The present invention refers to the extraction of parallelepiped shaped blocks of rock from a rock formation and to an extractor to be used for such purpose.

The extraction of ornamental blocks of rock from rock formations, especially of granite, began to show signs of advancement in recent years with the development of specific explosives. Such explosives are placed in drill holes aligned along one or more cutting planes and then detonated simultaneously so as to make extraction more rapid.

FIGS. 1 to 4 of the accompanying drawings illustrate the most common method presently used for the extraction of blocks of rock from solid rock formations. Fundamentally, it comprises the following steps:

Step 1: as shown in FIG. 1, a large block of rock having, for example, a volume of 100 to 400 cubic meters is freed from the rock formation. Slots or channels are opened along the sides of the block of rock to be removed so as to relieve internal stresses. The slots or channels are normally opened by means of jet flame burners or slot-drills forming secant perforations.

Rear, vertical and/or horizontal perforations are then drilled and the rock block is separated by the simultaneous detonation of explosives placed in such perforations.

One manner of carrying out this method is to take advantage of the natural separations found in many rock formations. In order to extract the block, it is sufficient to drill the spaced aligned perforations suitably arranged in a plane normal to the plane defined by the natural separation in the rock formation and then to detonate the explosives placed in such perforations.

Another manner is not to make the vertical perforations, but rather to open a rear slot or channel and to drill perforations in the plane of the natural separation, then simultaneously detonating the explosives placed in such perforations.

Stage 2: as shown in FIG. 2, in this step the block of rock is sub-divided along the planes of separation defined by corresponding aligned drillings, separation being obtained by means of explosives or metal plugs driven into the drillings so as to produce smaller blocks of rock of commercial size.

Stage 3: as shown in FIG. 3, this stage concerns the finishing of the block of rock by squaring it perfectly using closely spaced aligned drillings, the block being cut by means of plugs driven into the drillings or alternatively cutting is effected by means of manual tools. Only then will the block be in condition for being passed for final processing in rock slicing machines.

The following problems in the above method are to be noted:

- low yield. When explosives are used, the block does not always separate from the rock formation in the manner intended, be it due to lack of precision in the calculations for the explosive, be it due to a misalignment of the rear perforations with respect to the cutting plane;
- since the vertical and horizontal perforations are normally deep, it is necessary, as shown in FIG. 4, to provide for an angle greater than 90° between the planes formed therebetween so as to avoid jamming of the separated block. This makes it necessary to square the block of rock later which means loss of material and additional finishing work.

The purpose of the present invention is to overcome the majority of the above problems by means of a process that permits the extraction of effectively already finished blocks that do not have the cracks or microfissures that usually appear when conventional processes are used, thus ensuring an improved yield with less labour.

A further object of the present invention is to provide an extractor of blocks of rock for carrying out the process.

SUMMARY OF THE INVENTION

According to the present invention, a process for preparing the exposed surface of a rock formation to permit the extraction of parallelepiped shaped blocks of rock ready for final processing, comprises the steps of:

a) cutting into the surface of the rock formation a slot having a depth substantially equal to a width dimension of said blocks;

b) drilling into said surface of the rock formation a first series of parallel aligned perforations orthogonal to said slot, said perforations terminating along the bottom of said slot and defining a first cutting surface orthogonal to the plane of said slot;

c) drilling into said surface of the rock formation a plurality of parallel second series of parallel aligned perforations, said perforations of each of said second series defining a second cutting surface orthogonal to the plane of said slot and to said first cutting surface;

d) separating by the use of plugs applied in the perforations of said first and second series, the blocks defined by steps a) to c); and e) carrying out steps a) to d) repeatedly so the slot of step a) is cut from the exposed surface of the rock formation, beginning along a line defined by the outer ends of the perforations of said first series of perforations, whereby the exposed surface of the rock formation, after extraction of the various blocks in steps d), acquires a stepped profile.

Further according to the invention, a process for extracting parallelepiped shaped blocks of rock ready for final processing, from a rock formation having an exposed surface with a stepped profile, comprises the steps of:

a) cutting orthogonally into a first surface of one step of said stepped profile a slot of a depth equal to that of the second surface of the same step, said slot being cut slightly above the plane of the second surface of the immediately previous step;

b) cutting orthogonally into the second surface of the same step a first series of parallel aligned perforations along the junction between said second surface of the same step and the first surface of the immediately following step, the perforations of the first series extending to the bottom of said slot;

c) cutting orthogonally into the second surface of the same step a plurality of parallel second series of parallel aligned perforations extending to said slot, said second series defining lines normal to said junction;

d) separating by the use of plugs applied in the perforations of said first, and second series, the blocks defined by steps a) to c); and e) repeating steps a) to d) with respect to the following steps of the profile of said rock formation, extracting the respective blocks of rock.

Preferably, the slot is cut by means of secant perforations and the first, second and third series of perforations are effected by drilling hammers.

The present invention also provides an extractor for extracting blocks of rock from a rock formation, that comprises a structure formed by a front frame, a central frame and a rear frame, said front and rear frames being perpendicular to said central frame, each said frame being associated with at least one respective perforation system.

Each perforation system preferably includes at least one pair of rails and a support carriage mounted for displacement along said rails, the pairs of rails of the three perforation systems being orthogonal with respect to each other.

Moreover, the support carriage of each perforation system may include a pair of upright support guides perpendicular to its respective pair of rails, a perforation tool being displaceable along said support guides.

The perforation system associated with said front frame may be a slot-cutter whereas the perforation systems associated with the central and rear frames may comprise hammer drills.

The carriages of the extractor are preferably driven by electric motors and locking means may be provided for locking each carriage in predetermined positions along their respective pairs of rails, adjustable support jacks being arranged under said central and rear frames for the correct positioning of said extractor on a rock formation.

Auxiliary wheels on the central and rear frames may be included for the support and displacement of the extractor over the rock formation.

BRIEF DESCRIPTION OF THE DRAWINGS

FIG. 7 is a front view of the formation indicating a suitable position for the cuts to be made for separating the slice of rock;

FIG. 7*a* is a longitudinal section illustrating the manner of choosing the longitudinal axis of the slice;

FIG. 8 shows the slice of FIGS. 7 and 7*a* when a first face has been severed from the formation;

FIG. 26 shows a slice of rock from which blocks are being produced;

FIGS. 27, 28, and 29 are perspective illustrations of the three steps of cutting and removing blocks of rock according to the method of this invention;

FIG. 32 is a simplified representation of a three frame extractor used in the method of the present invention;

FIG. 33 is a side view of the extractor;

FIG. 36 shows the central frame of the extractor;

FIG. 37 shows a cable and winch system for displacing the extractor;

FIG. 38 is a detail showing the manner in which the extractor is supported during displacement;

FIG. 39 shows how the rear frame is supported during displacement; and

DESCRIPTION OF THE PREFERRED EMBODIMENTS

Figure 1:
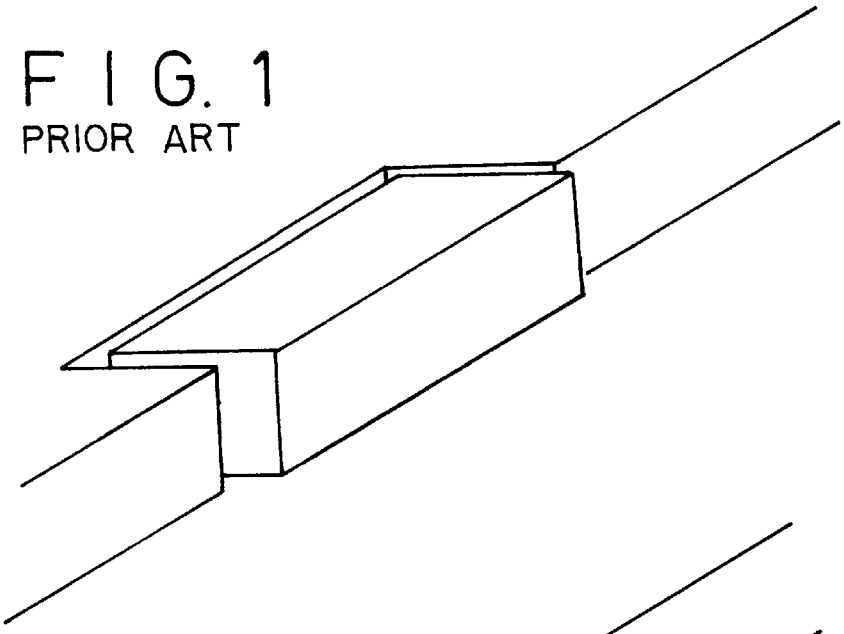
FIG. 1 PRIOR ART
FIGS. 1 to 4 show the sequence of steps in a prior art method of extracting blocks of rock from solid rock formations.
Figure 2:
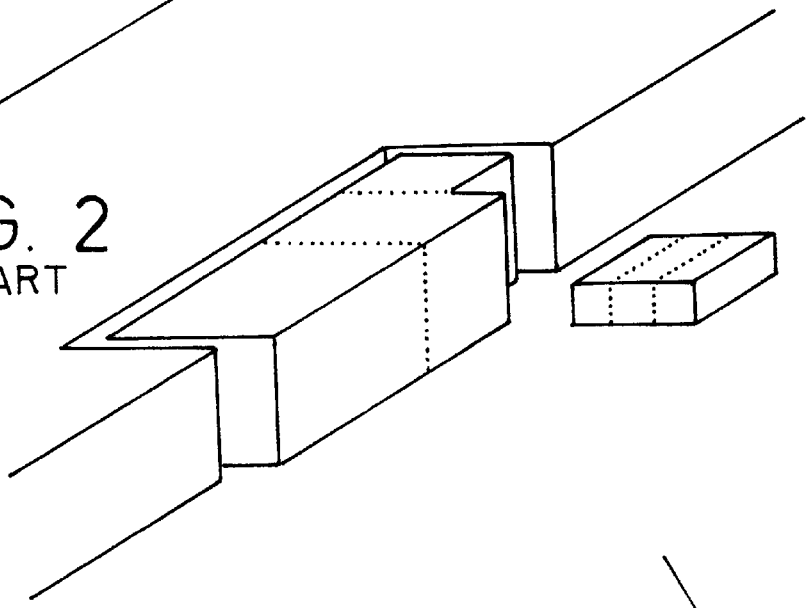
FIG. 2 PRIOR ART
Figure 3:
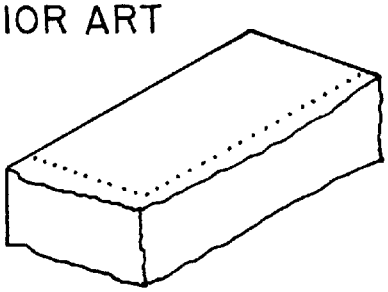
FIG. 3 PRIOR ART
Figure 4:
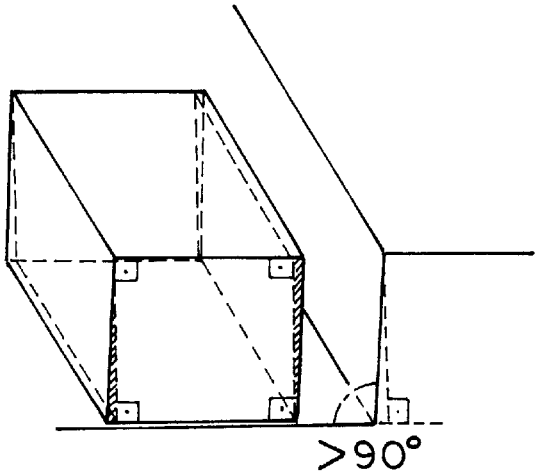
FIG. 4 PRIOR ART
Figures 5, 6, 6A:
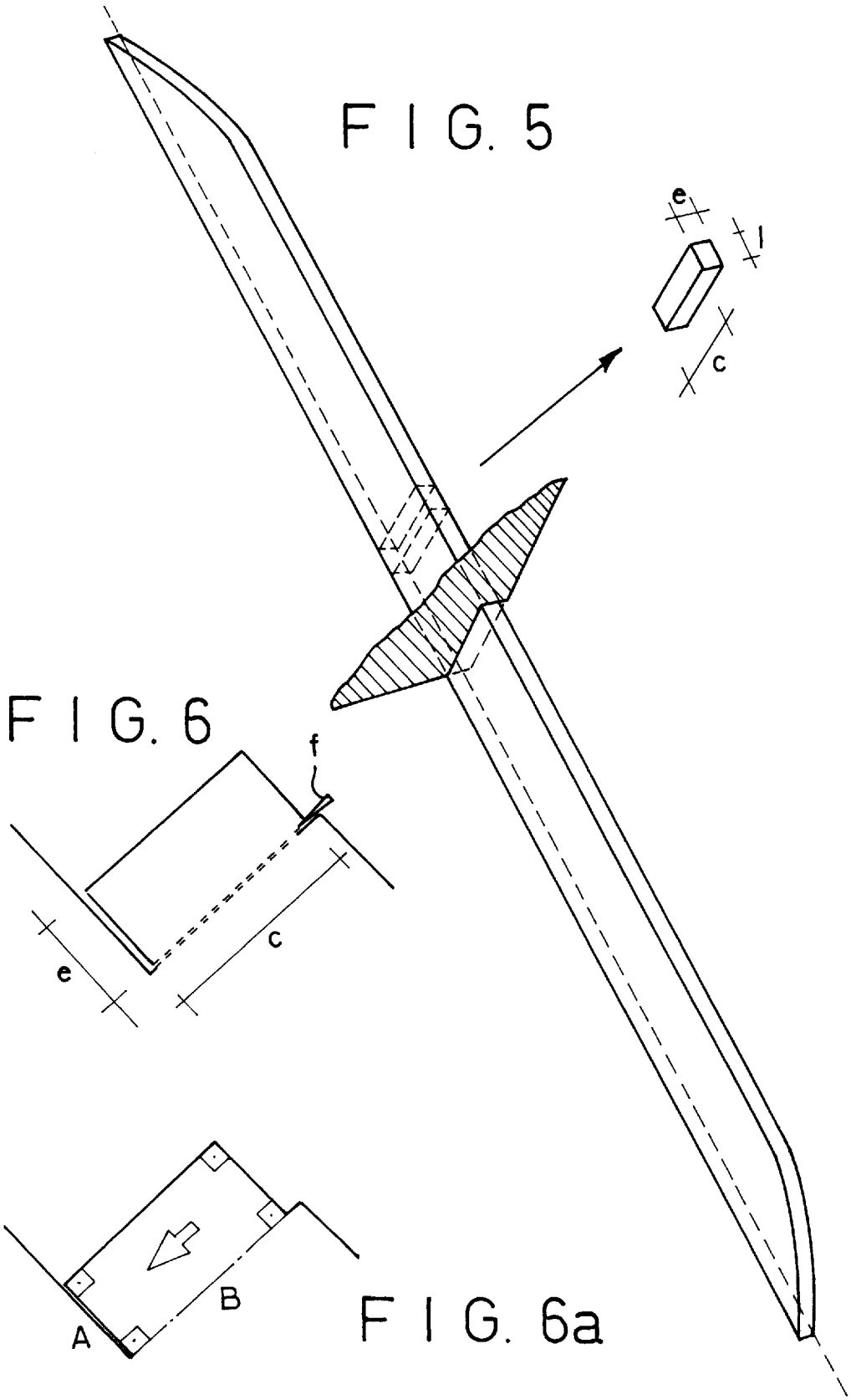
FIG. 5 illustrates a slice of rock removed from a solid rock formation in a first step in preparing a stepped profile for a method according to the present invention.
FIG. 6 shows the same slice of rock after one face has been separated from the formation.
FIG. 6*a* shows the slice of rock after its second face has been severed from the formation.

A process according to the present invention will now be described, by way of example, with reference to FIGS. 5 to 30 of the accompanying drawings, in which:

FIG. 5 shows a slice of rock displaced from the rock formation and having a width and height equal to the thickness (e) and length (c) of the blocks of rock to be extracted.

After the slice of rock is freed, it is chopped into blocks of rock having the desired width L of the blocks so that they can be extracted without requiring finishing.

In this process the slot or channel is opened with a slot-drill using secant perforations. The slot is opened on or near the rising or levant plane of the rock formation and has a depth equal to the depth of the block of rock to be extracted.

In the conventional processes, the slot is opened vertically or perpendicularly to natural separations, when there are any in the rock formation, and is normally deeper than that used in the present process.

Since the depth of the slot is now limited to the thickness of the blocks, its opening is facilitated in a position where it is difficult to work, it being possible to make it horizontal or inclined to accompany the levant plane of the rock formation.

FIG. 6 shows the slice of rock with the bottom slot opened and still held to the rock formation by means of face B. When face B is cut by means of plugs, the weight of the block makes it displace itself by a few centimeters which assists in the freeing of the individual blocks at the time of their extraction. (See FIG. 6*a*.)

Since the height of the slice of rock is limited to the length of the blocks to be extracted, cutting face B, which is still part of the rock formation, by means of metal plugs is facilitated, there being no need for the use of explosives.

FIG. 7 is a front view of the rock formation and preliminarily defines the most suitable position for extraction of the blocks of rock, taking the following into consideration:

the cutting planes of the rock. The closer the perforations are situated to such planes, the more spaced they may be, which makes extraction more economical;

the designs on the rock formation in relation to the finished blocks; and the equipment to be used for manoeuvering the blocks of rock during extraction.

Once the position of the slice of rock to be extracted from the rock formation has been defined, a slot A is first opened in the surface of the rock formation by means of continuous cut drilling to define a face A. Preferably, face A accompanies the levant plane of the formation and the corresponding slot A is opened using secant perforations.

Face B, perpendicular to face A, is cut using metal plugs, in a plane of perforations made with hammer drills, the spacing between perforations being determined by the type of rock formation.

As shown in FIG. 7*a,* axis YY'—which is the intersection of faces A and B—should be positioned in such a way that it passes out of the exposed surface of the rock formation at its two ends, it having an inclination (alpha) with respect to the horizontal that permits gravity assisted withdrawal of the blocks. As can be seen from FIG. 8, after cutting of face A, the material (slice of rock) to be initially extracted will be held to the formation only by face B.

Figure 9:
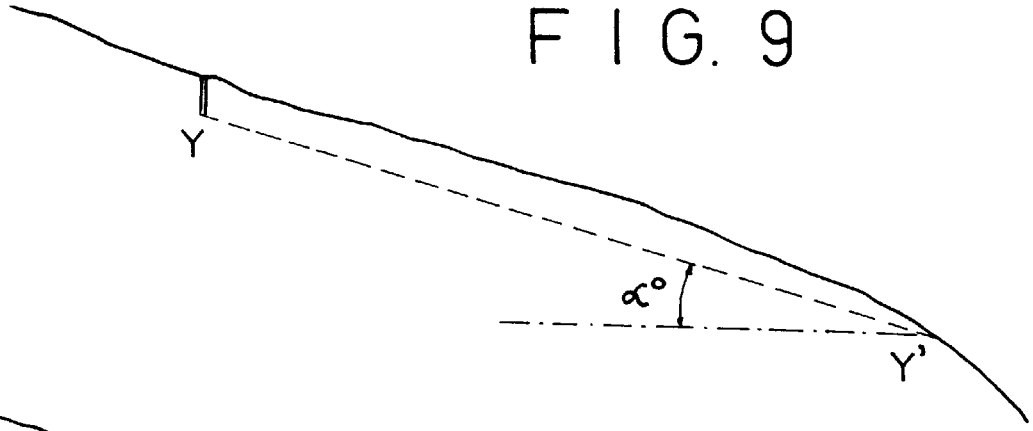
FIG. 9 illustrates the manner of selecting the position of the cuts to remove a slice of rock when the surface of the formation falls away to a lesser extent at one end than in the case of FIG. 7*a;*
Figure 9A:
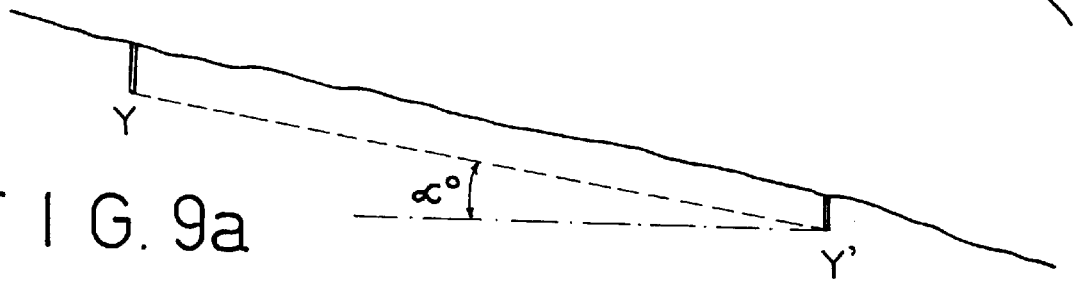
FIG. 9*a* illustrates the manner of selecting the position of the cuts to remove a slice of rock when the surface of the formation falls away to a lesser extent at both ends than in the case of FIG. 7*a;*

It will be understood from FIGS. 9 and 9*a* that, if the rock formation does not fall away at the two ends of axis YY', it will be necessary to open a slot with the slot rill using secant perforations at one of the ends of axis YY', depending on the case.

Figure 10:
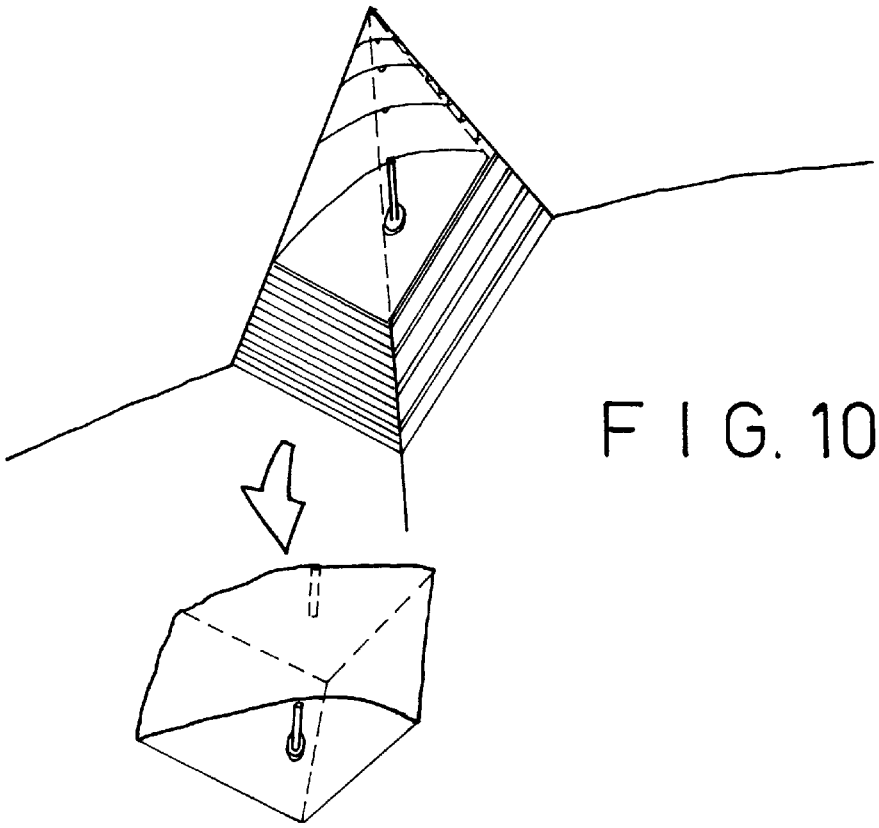
FIG. 10 is a perspective view of a reentrance opened in the rock formation as a first stage for the removal of the initial slice of rock.
Figure 11:
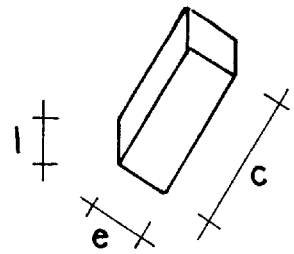
FIG. 11 is a perspective view of a typical block of rock to be removed according to the method of the present invention.
Figure 12:
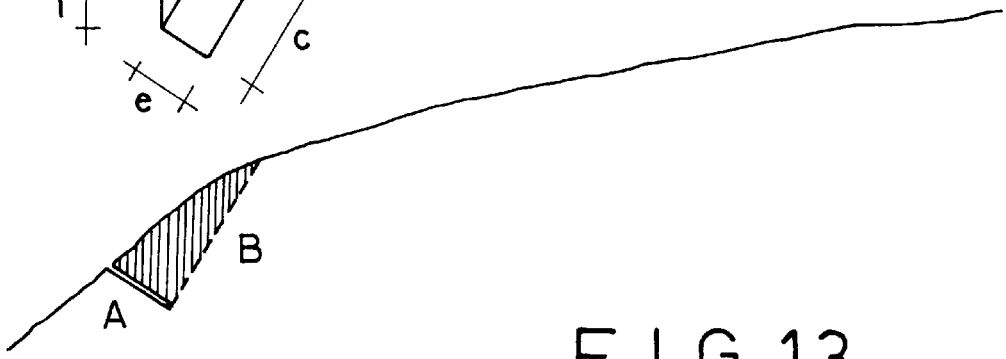
FIGS. 12 to 16 show the sequence of steps removing a series of slices of rock to prepare the stepped formation in the rock formation.

FIG. 10 is a perspective view of the reentrance opened in the rock formation during the first stage of removal of the initial slice of rock.

The material extracted on forming faces A and B (see also FIG. 12) does not provide blocks of rock at this stage. It will be cut into sizes that may be removed with the handling equipment available at the site. Such cutting may be effected using explosives in split perforations.

Next, face $A_1$, parallel to face A, is cut using the same method of cutting as used for face A. The distance between face A and face $A_1$ will be the length (c) of the extracted block plus an amount Z.

Figure 13:
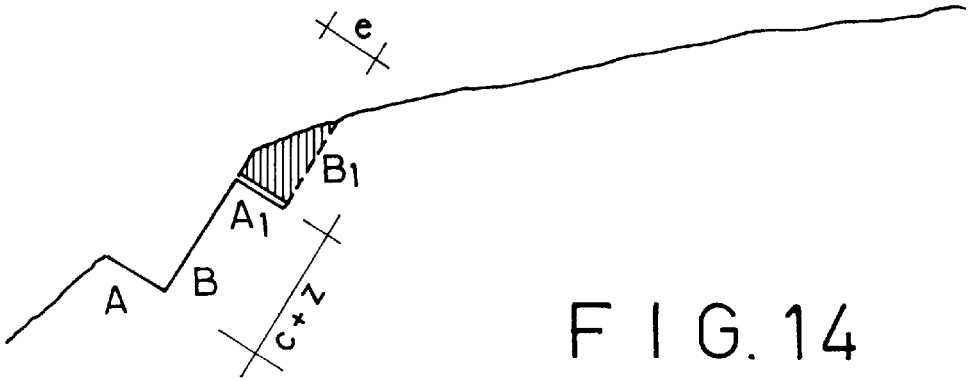

FIG. 13 shows the cutting of face $B_1$ parallel to face B, using the same method as for cutting face B. The distance between face B and face $B_1$ will be the same as the thickness (e) of the block of rock to be extracted.

The mass of rock between faces $A_1$ and $B_1$ will not produce a block and will be extracted precisely as was that between faces A and B.

Figure 14:
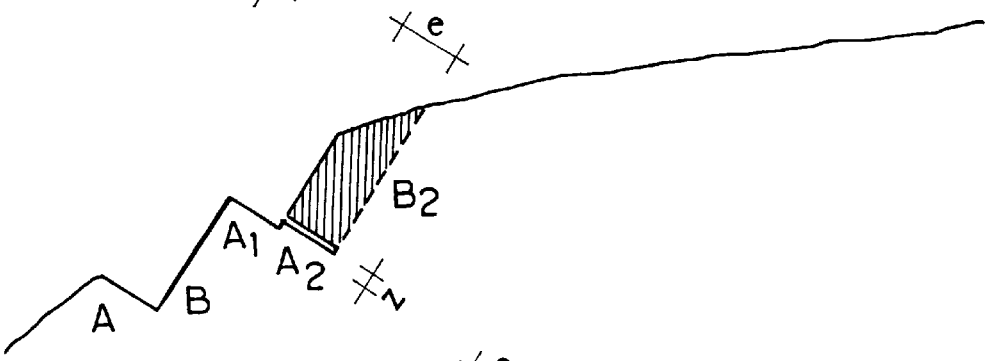

FIG. 14 shows the sequential cutting of faces $A_2$ and $B_2$. Face $A_2$ is parallel to face $A_1$ with a spacing Z. The mass of rock delimited by faces $A_2$ and $B_2$ will be extracted just as in the case of the mass between faces A and B.

Figure 15:
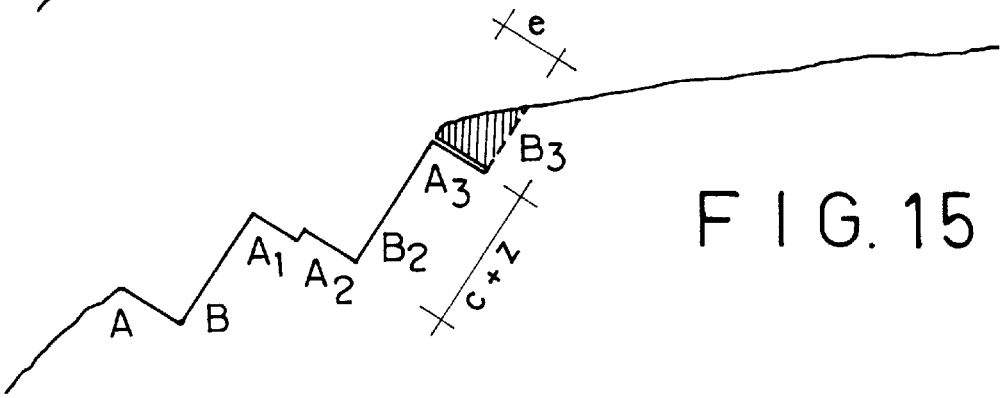

As shown in FIG. 15, faces $A_3$ and $B_3$ are then cut. Face $A_3$ is parallel to face $A_2$ and their spacing is equal to the distance between faces A and $A_1$. Face $B_3$ is parallel to face $B_2$ and their spacing is the same as the thickness (e) of the block of rock to be extracted. The mass of rock delimited by faces $A_3$ and $B_3$ is removed in the same manner as the mass between faces A and B, as shown in FIG. 15.

Whenever a new face An is cut, it will be separated from face $A_{n-1}$ by (c+Z). If it does not attain this value, then the latter will be only Z.

Figure 16:
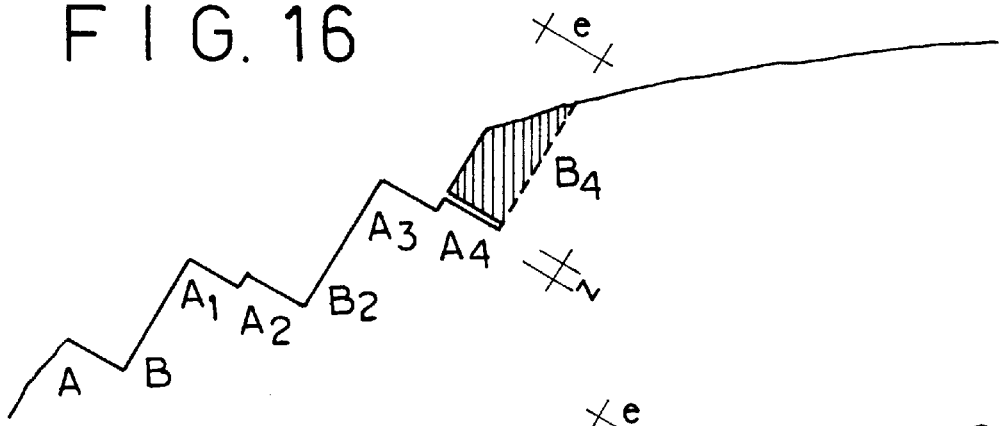
Figure 17:
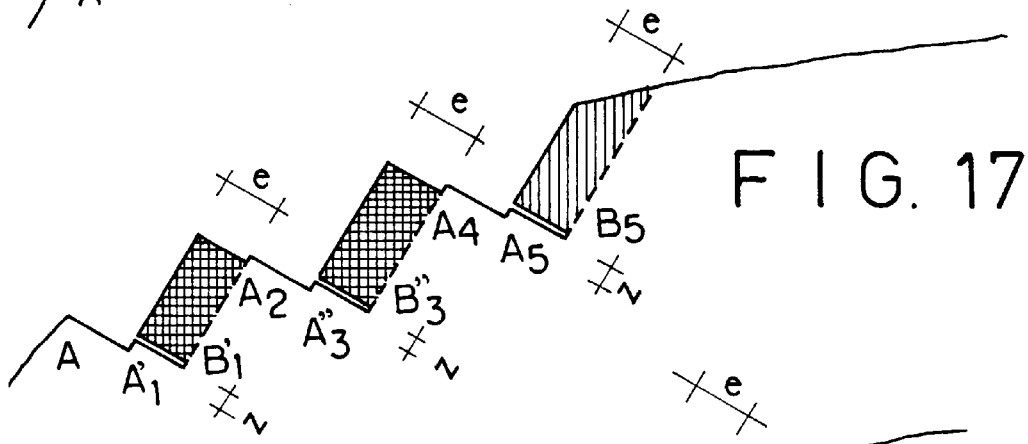
FIGS. 17 to 23 show the sequence of steps in which blocks of rock are removed in accordance with the invention and further slices of rock are removed as necessary.
Figure 18:
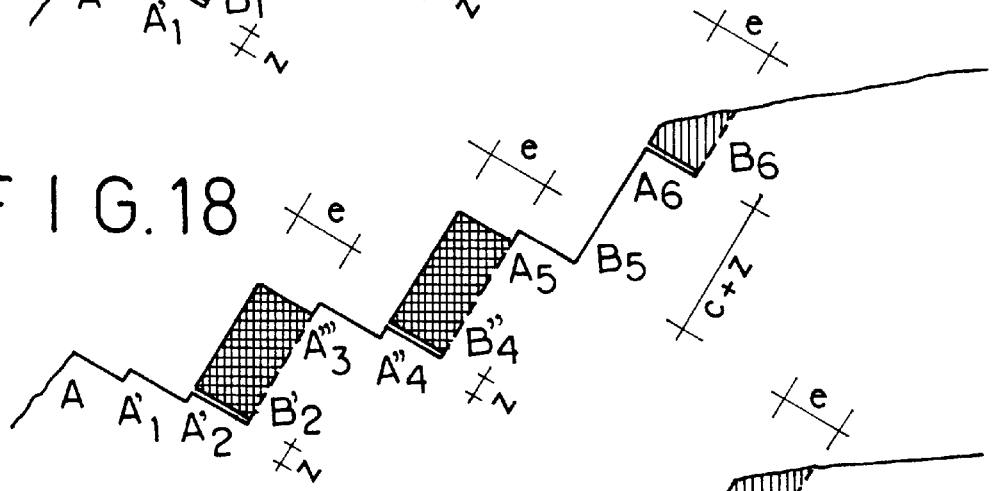
Figure 19:
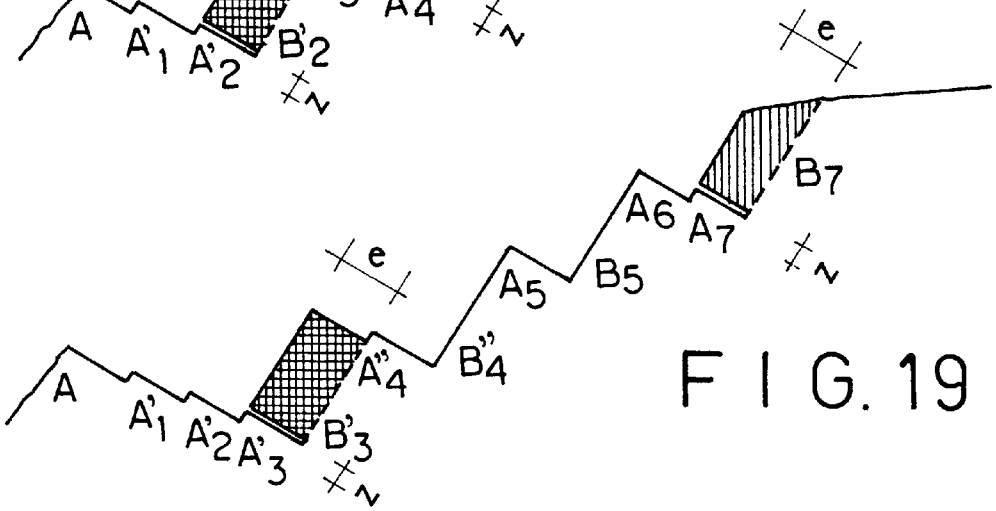
Figure 20:
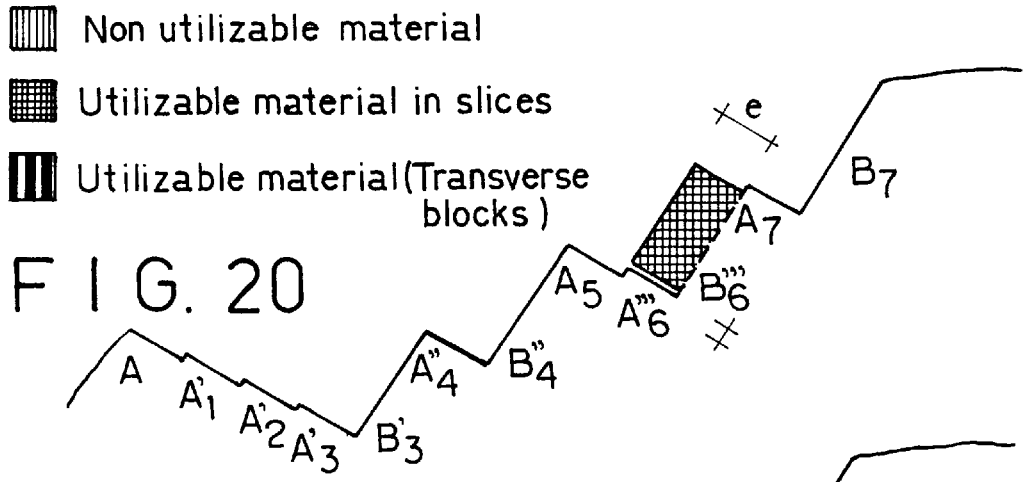
Figure 21:
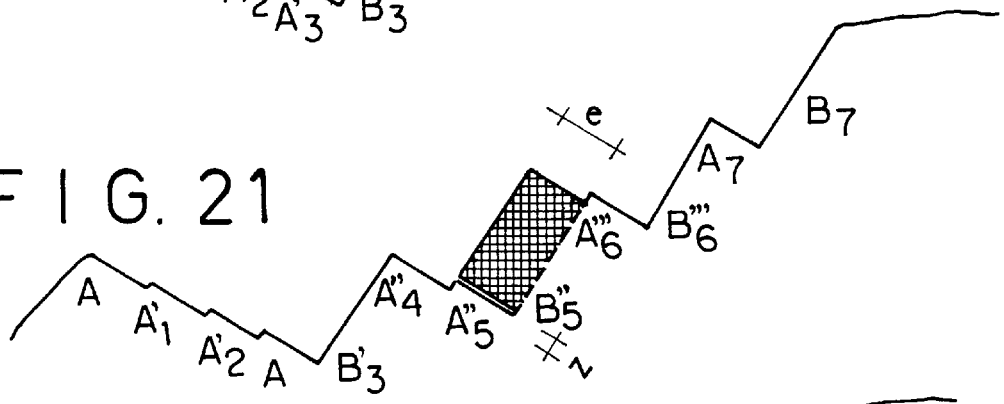
Figure 22:
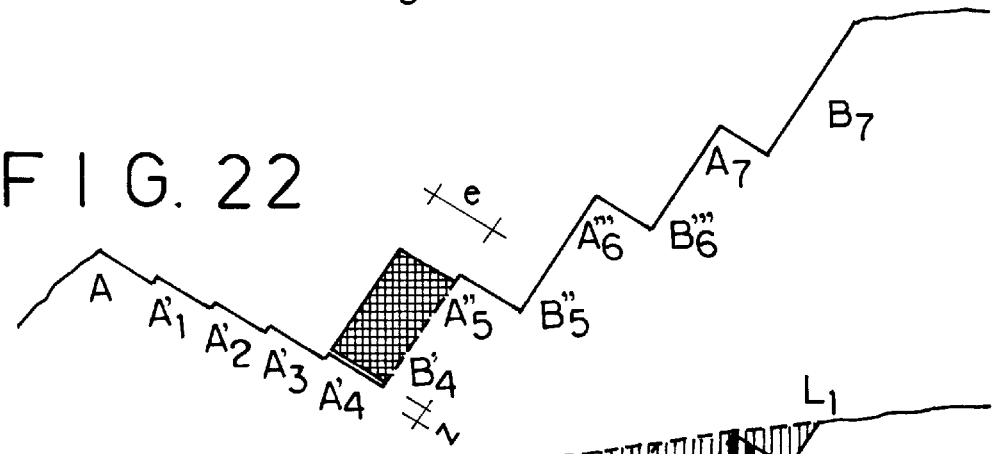

FIG. 16 shows the cutting of faces $A_4$ and $B_4$ in the same manner as faces $A_2$ and $B_2$ and the mass of rock therebetween will be removed as in the case of the mass between faces A and B.

Faces $A_1$' are $B_1$' are cut, face $A_1$' being spaced by Z from face A and face $B_1$' following the direction of face $B_1$ at the point where the perforatons in face $B_1$ terminate.

FIGS. 17 to 23 show the sequence of the continuation of the cutting of slices from faces $A_n$ and $B_n$.

Figure 24:
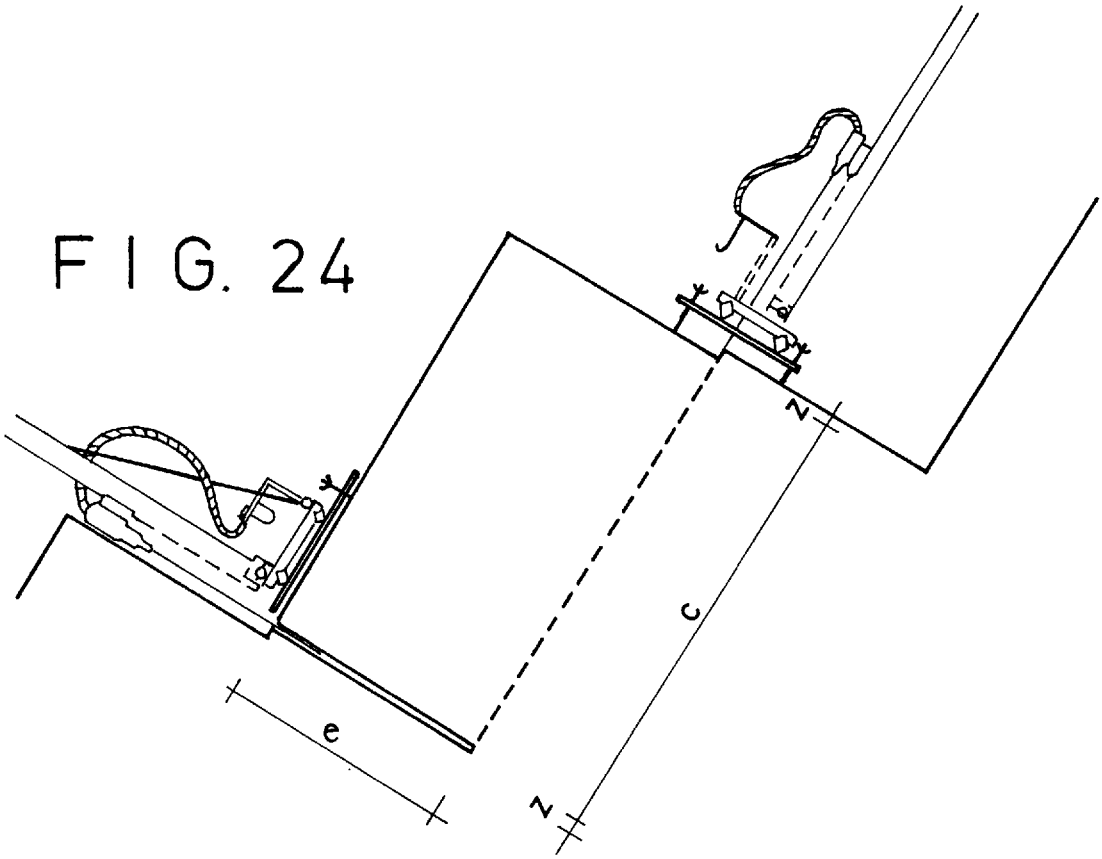
FIG. 24 illustrates the minimum space possible for the cutting of the first face of a block.

As is shown in FIG. 24, Z is the smallest dimension in which the drill succeeds in cutting between two faces An and $A_{n-1}$, it being noted that, in order to cut a face $B_n$ of a slice, it has to has to have the continuity of face $B_n$ of the immediately following or upper block of rock.

Figure 25:
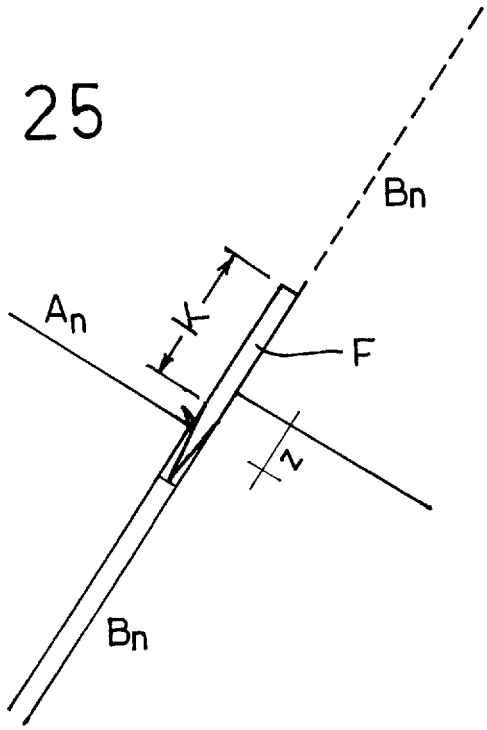
FIG. 25 shows the cutting of the second face of a block.

FIG. 25 shows a plug F. In order to cut a face $B_n$ next to a step, one has to use a plug F having a body length K greater than Z.

FIG. 26 shows a slice of rock when blocks are being produced. The slice formed by faces $A_n$ and $B_n$ is sliced during block extraction along faces C, $C_1$, $C_2$ . . . $C_n$ which are parallel to each other and perpendicular to axis YY', being spaced from each other by a distance equal to the width L of the blocks of rock to be extracted.

As shown in FIG. 27, the cutting of faces $C_n$ is effected using metal plugs in drilling planes made with hammer drills, the perforation interspacings being determined by the type of rock.

With reference to FIG. 28, cutting of faces $C_n$ with plugs is only effected after removing the block of rock originating from face $C_{n-1}$. After cutting face $C_n$ with plugs, a larger diameter plug G is used at the lower region of face $C_n$ to separate the block of rock at this point from the rest of the slice of rock by a further 1 or 2 centimeters, this avoiding jamming. After this procedure, a steel cable Q is tied to the top of the block of rock and hauled in the direction of axis YY'. As can be seen from FIG. 29, the block of rock which was at right angles to axis YY', turns about an axis formed by face An with face $C_n$ so as to lie along axis YY'. This rotation is relatively smooth since the block of rock is supported and therefore will be dragged over face B during the turn without damaging the block. Once it is lying in position, the block of rock will be further hauled until it leaves the rock formation. It will then be ready, without any need for squaring operations or other basic finishing.

It should be noted that, at this point, the first cuts C, $C_1$, $C_2$ . . . made in triangular parts of the rock slices will not produce blocks of rock and the distances between such cuts are determined as a function of the masses of rock to be removed.

Figure 23:
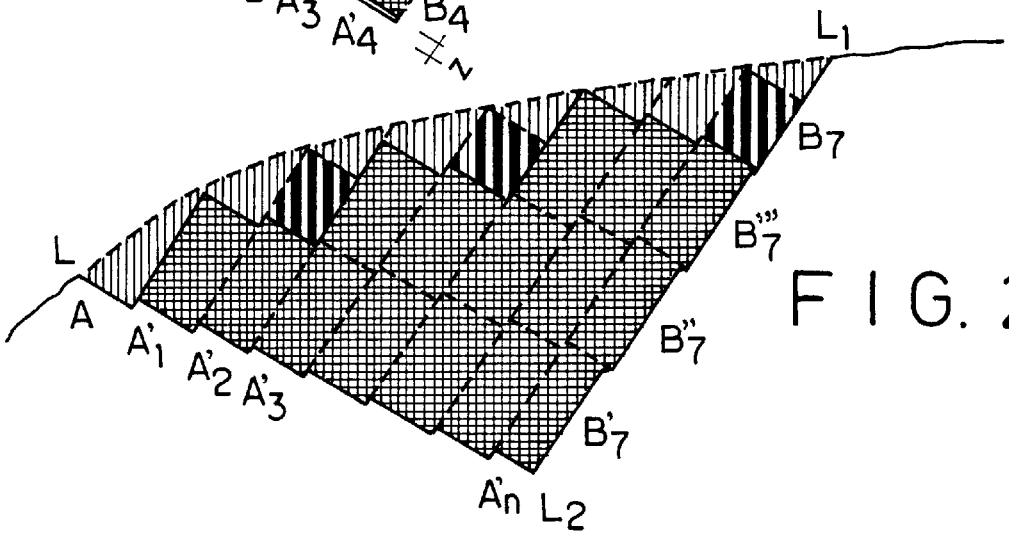

On removal of the last slice from faces $A_n$ and $B_n$, a formation L-$L_1$-$L_2$ will appear, representing the total volume f worked rock, as can be seen from FIG. 23.

It will be observed that the last blocks of rock supported on face $B_n$ at the end of the formation will have a smaller thickness (e) due to the impossibility of maintaining the same alignment during cutting of such last face.

When axis YY' perforates the rock at its lower end (FIG. 9), the block of rock may be hauled off the rock formation with steel cables, it being possible to adjust angle alpha so as to make better use of gravity assistance during this manoeuver.

Where there is no possibility of hauling along axis YY' (FIG. 9*a*), the blocks of rock may be removed by strategically placed cranes.

Figure 30:
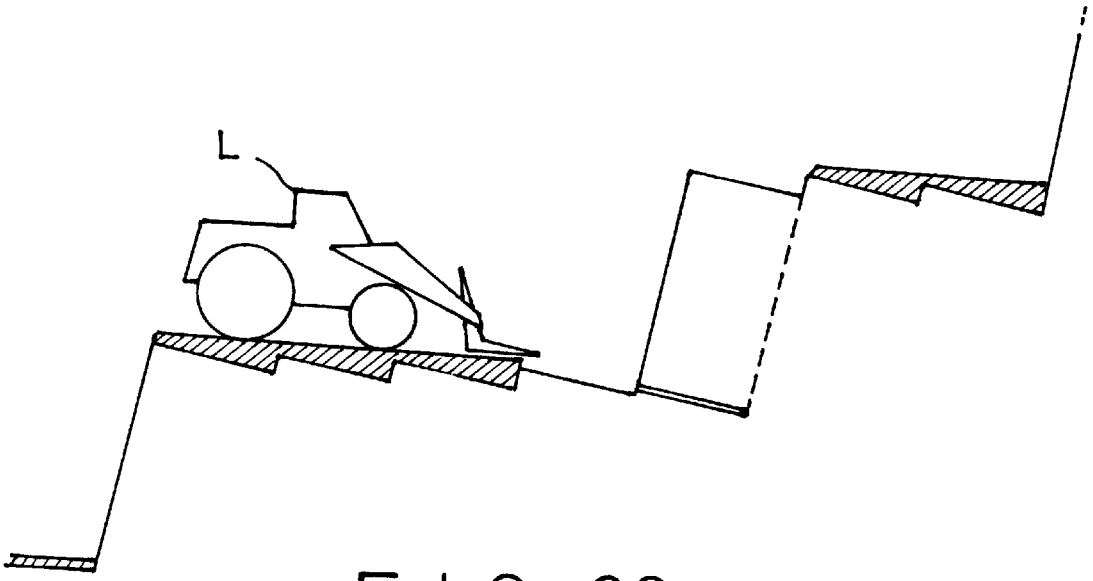
FIGS. 30 and 31 illustrate the use of a fork lift loader to remove a block of rock.
Figure 31:
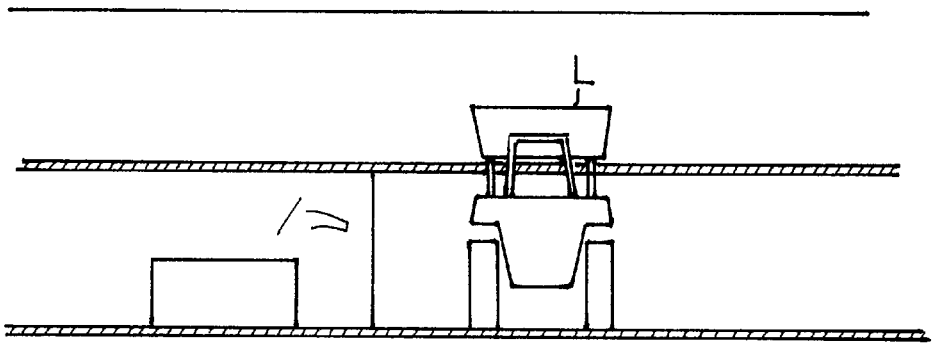

As shown in FIG. 30, when fork lift loaders are used to handle the blocks of rock, they will require platforms on which they can be driven. For this purpose, axis YY' will be made close to horizontal with a small inclination sufficient to ensure suitable drainage of rain water, as seen in FIG. 31. A layer of earth will then be spread over the tops of the blocks of rock (face A) so as to produce a platform having a regular surface where it is easy to operate the loaders. This earth will be removed as the lower platform advances.

The process of the present invention provides for the slots or channels of secant perforations to be opened in an inclined position varying from 45° to almost horizontal. Existing equipment for opening such slots have been designed to work vertically or nearly vertically and at depths of up to six meters, it being difficult to adapt them to surfaces with steep inclinations.

An extractor for blocks of rock according to the present invention will now be described in detail with respect to an exemplary embodiment shown in FIGS. 32 to 40.

FIGS. 32 and 33 show such an extractor which comprises a metallic structure formed from a front frame R, a central frame T and a rear frame S. Front frame R and rear frame S are perpendicular to central frame T, each having a respective perforation system.

Figure 34:
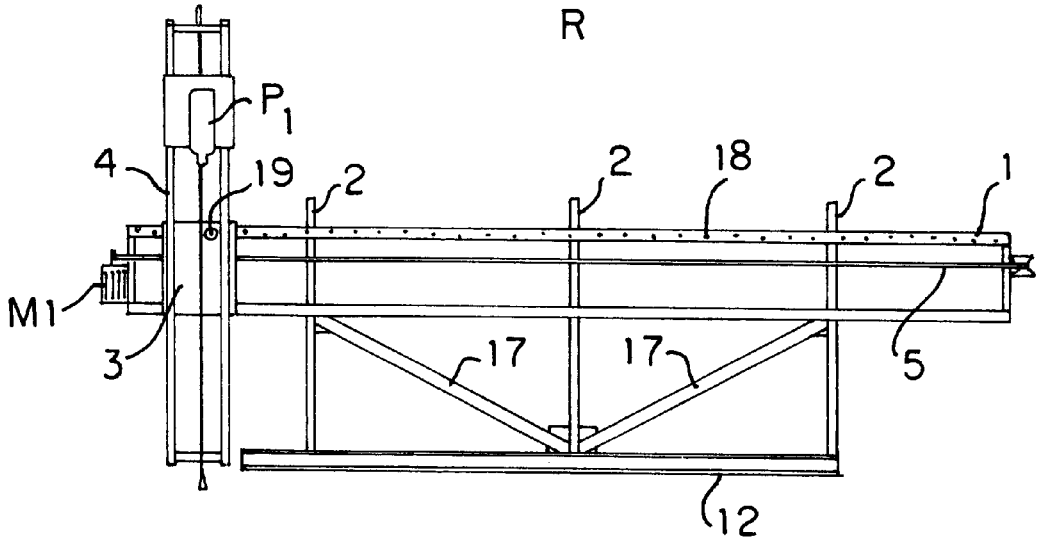
FIG. 34 shows the front frame of the extractor.

As can be seen in FIG. 34, the front frame is comprised of a two-rail track 1 supported on three bars 2. On track 1 runs a carriage 3 which is the support for an upright support guide 4 that carries a slot drill $P_1$ that opens the slot or channel of secant perforations. Carriage 3 is displaceable by means of a chain 5 driven by electric motor $M_1$. The upper portion of track 1 is provided with orifices 18 with spacings equal to the spacings between the perforations made in opening the continuous slot. Carriage 3 has an orifice 19 that coincides with orifices 18 so that it may be locked during opening of the perforations by drill $P_1$ (FIG. 34).

Figure 35:
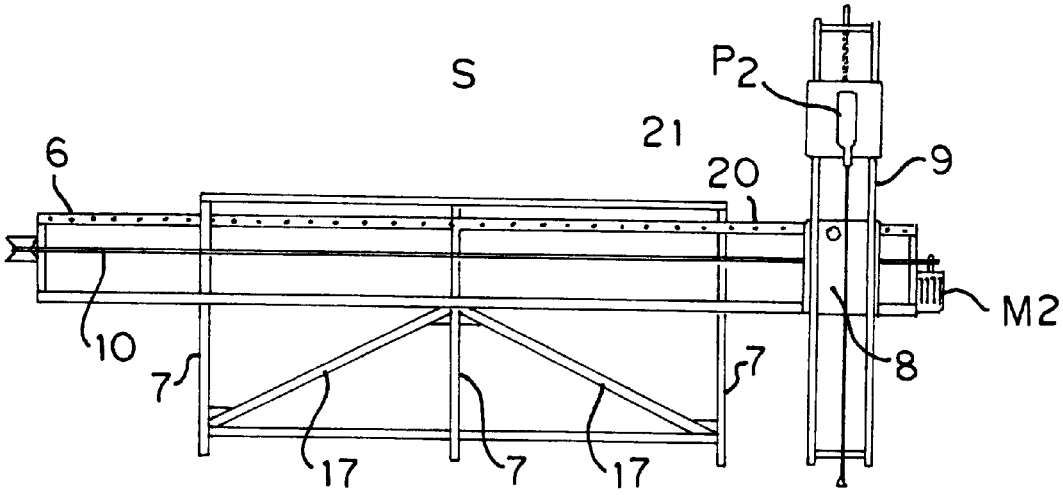
FIG. 35 shows the rear frame of the extractor.

FIG. 35 shows that rear frame S is comprised of a two-rail track 6 supported on three supports 7. A carriage 8 runs on this track and mounts support guide 9 that carries a hammer drill $P_2$ which opens the face B perforations perpendicular to the continuous slot of face A. Carriage 8 is also moved by a chain 10 driven by an electric motor $M_2$. The upper portion of track 6 is formed with orifices 20 with spacings equal to the spacing between the perforations made by hammer drill $P_2$. Carriage 8 has an orifice 21 that will coincide with orifices 20, permitting locking during drilling by hammer drill $P_2$.

FIG. 36 shows the central frame T that is comprised of three two-rail tracks 11 supported on parts 12 and 13. Part 12 serves as a base for the three bars 2 of front frame R. In their turn, tracks 11 support the three bars 7 of the rear frame S. On each track 11 runs a carriage 14 mounting a support guide 15 that carries a hammer drill $P_3$ for drilling the perforations parallel to the slot in the blocks of rock. Carriage 14 runs on a rack 16, being moved by a cooperating pinion driven by an electric motor $M_3$. Each track 11 is provided with orifices 22 with spacings equal to the spacing between the perforations made by the corresponding hammer drill $P_3$. Carriage 14 has an orifice 23 that coincides with orifices 22, permitting locking during drilling by hammer drill $P_3$.

Frames R, S and T are reinforced with auxiliary beams 17 to increase the rigidity of the structure.

As shown in FIG. 37, in order to change the working position, the extractor may be displaced by a system of steel cables 24 operated by a winch 25.

FIG. 38 shows how the extractor is supported during displacement. This is effected by means of three guide wheels 26 positioned at the edge formed by faces A and B of the slice of rock that have already been cut, as well as of four auxiliary wheels 27.

During drilling, the extractor is supported on four support jacks 28 that permit the correct positioning of the extractor on the rock.

FIG. 39 shows how the rear frame S is displaced along tracks 11 so as to facilitate the initial phase of drilling. In this position, both the auxiliary wheels 27 and the support jacks 28 work in positions that are perpendicular to the rock. As shown in FIG. 38, such wheels and jacks are pivotally mounted on the extractor.

Figure 40:
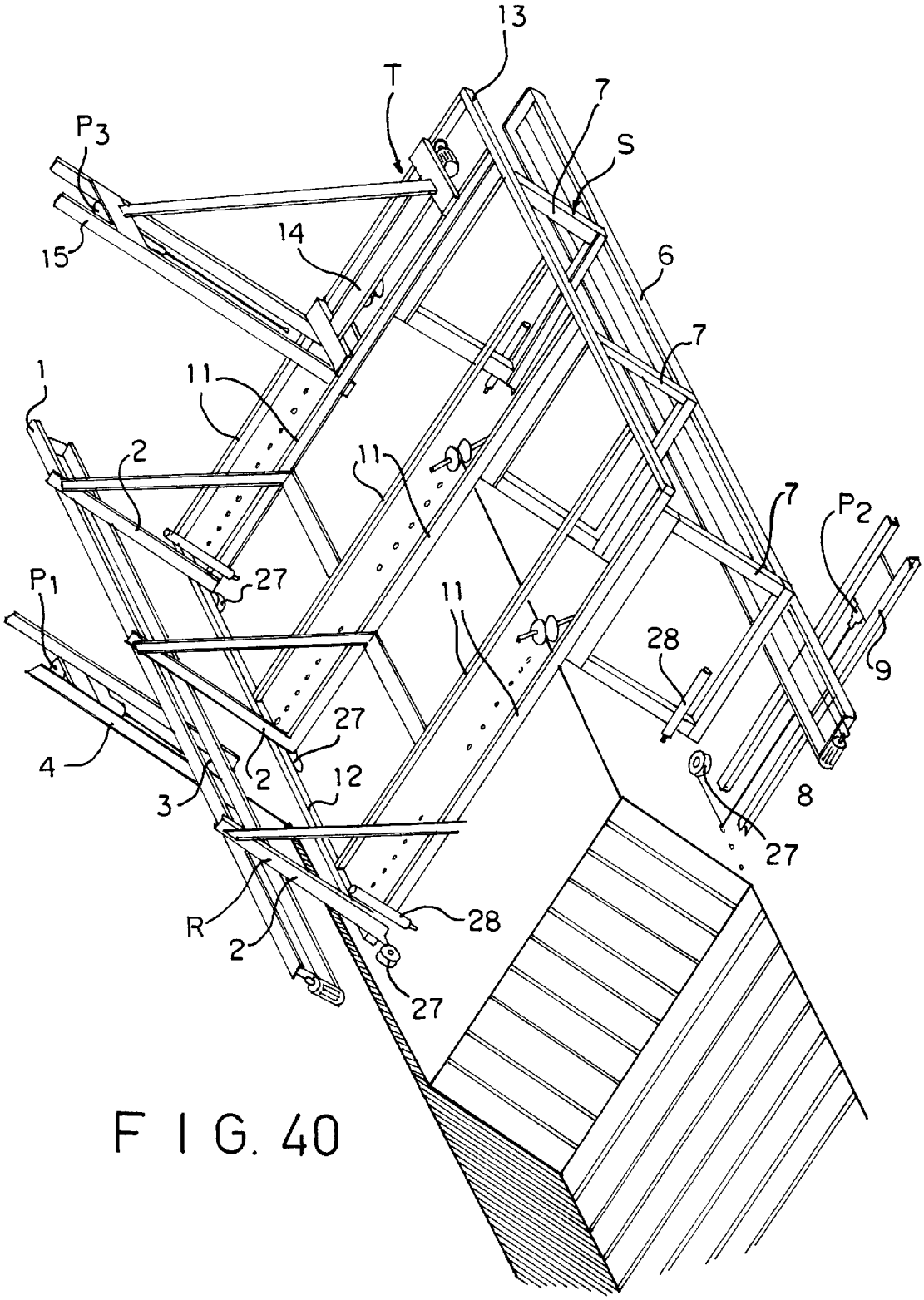
FIG. 40 is a detailed perspective view of the complete structure of the extractor during use.

Finally, FIG. 40 is a perspective view of the complete metal structure formed by frames R, S and T. The auxiliary reinforcement beams and two of the perforation systems, however, are omitted for clarity of representation.

It is believed that the advantages of the present invention when compared with the conventional techniques described at the beginning of this specification will be abundantly clear to a person versed in the art. This, however, is further emphasized when one considers that, quite apart from the savings in labour costs and the convenience of not having to provide a site for the various finishing operations of the prior art, an enormous increase in yield of the reserve of rock in the formation may be obtained. This can to a certain extent be estimated in numerical terms. For example, in a given rock formation, as little as 20% of the rock removed may be used for commercialisation. Using the method and preferred embodiment of extractor of the present invention, on the other hand, this yield may be increased to values exceeding 60%.

It will also be appreciated that the method of this invention does not depend exclusively on the use of the specific extractor illustrated and described herein. Thus much of the benefit of the invention can still be obtained if the perforation and cutting of each face $B_n$ is terminated before the perforation and cutting of the individual faces $C_1$ to $C_n$, this latter being done after the whole slice of rock has been separated from the rock formation.

What is claimed is:

1. Process for preparing the exposed surface of a rock formation to permit the extraction of parallelepiped shaped blocks of rock ready for final processing, comprising the steps of:

a) cutting into the surface of the rock formation a slot having a depth substantially equal to a width dimension of said blocks;

b) drilling into said surface of the rock formation a first series of parallel aligned perforations orthogonal to said slot, said perforations terminating along the bottom of said slot and defining a first cutting surface orthogonal to the plane of said slot;

c) drilling into said surface of the rock formation a plurality of parallel second series of parallel aligned perforations, said perforations of each of said second series defining a second cutting surface orthogonal to the plane of said slot and to said first cutting surface;

d) separating by the use of plugs applied in the perforations of said first and second series, the blocks defined by steps a) to c); and e) carrying out steps a) to d) repeatedly so that the slot of step a) is cut from the exposed surface of the rock formation, beginning along a line defined by the outer ends of the perforations of said first series of perforations, whereby the exposed surface of the rock formation, after extraction of the various blocks in steps d), acquires a stepped profile.

2. Process according to claim 1 in which said slot or slots are cut by means of secant perforations.

3. Process according to claim 1, in which said first and second series of perforations are drilled with hammer drills.

4. Process according to claim 1, in which steps a), b) and c) are carried out at substantially the same time.

5. Process according to claim 1, in which step d) comprises first separating along said first cutting surface and then separating sequentially along said second cutting surfaces.

6. Process for extracting parallelepiped shaped blocks of rock ready for final processing, from a rock formation having an exposed surface with a stepped profile which has a plurality of steps including at least a first step, an immediately previous step, and an immediately following step, each of said steps having first and second surfaces which correspond to the first and second surfaces of other said steps, said formation having a junction formed by the second surface of said first step and the first surface of said immediately following step; said process comprising the steps of:

a) cutting a slot orthogonally into said first surface of said first step of said stepped profile, said slot having a depth equal to that of said second surface of said first step, said slot being cut slightly above the plane of said second surface of said immediately previous step;

b) cutting orthogonally into said second surface of said first step a first series of parallel aligned perforations along the junction between said second surface of said first step and said first surface of said immediately following step, the perforations of the first series extending to the bottom of said slot and defining a first cutting surface;

c) cutting orthogonally into the second surface of said first step a plurality of parallel second series of parallel aligned perforations extending to said slot, said second series defining second cutting surfaces which lie normal to said junction;

d) separating by the use of plugs applied in the perforations of said first and second series, the blocks defined by steps a) to c); and e) repeating steps a) to d) with respect to other steps of the profile of said rock formation, and extracting the respective blocks of rock.

7. Process according to claim 6, in which said slot or slots are cut by means of secant perforations.

8. Process according to claim 6, in which said first and second series of perforations are drilled with hammer drills.

9. Process according to of claim 6, in which steps a), b) and c) are carried out at substantially the same time.

10. Process according to claim 6, in which step d) comprises first separating along said first cutting surface and then separating sequentially along said second cutting surfaces.

11. Extractor for extracting blocks of rock from a rock formation, comprising a structure formed by a front frame (R), a central frame (T) and a rear frame (S), said front and rear frames (R,S) being perpendicular to said central frame (T), each said frame being associated with at least one respective perforation system; each said perforation system including at least one pair of rails and a support carriage mounted for displacement along said rails, the pairs of rails of three perforation systems being orthogonal with respect to each other; and, locking means for locking each carriage in predetermined positions along its respective pair of rails.

12. Extractor for extracting blocks of rock from a rock formation, comprising a structure formed by a front frame (R), a central frame (T) and a rear frame (S) said front and rear frames (R,S) being perpendicular to said central frame (T), each said frame being associated with at least one respective perforation system; said extractor having adjustable support jacks under said central and rear frames (T,S) for the correct positioning of said structure on a rock formation.

13. Extractor for extracting blocks of rock from a rock formation, comprising a structure formed by a front frame (R), a central frame (T) and a rear frame (S), said front and rear frames (R,S) being perpendicular to said central frame (T), each said frame being associated with at least one respective perforation system; said extractor having auxiliary wheels on said central and rear frames (T,S) for the correct positioning of said structure on a rock formation.

* * * * *